United States Patent [19]

Steinemann et al.

[11] 3,974,001

[45]*Aug. 10, 1976

[54] PARAMAGNETIC ALLOY

[75] Inventors: Samuel Steinemann, Waldenburg; Martin Peter, Petit-Lancy, both of Switzerland

[73] Assignee: Institut Dr. Ing. Reinhard Straumann, A.G., Waldenburg, Switzerland

[ * ] Notice: The portion of the term of this patent subsequent to Dec. 15, 1987, has been disclaimed.

[22] Filed: Oct. 9, 1974

[21] Appl. No.: 513,389

Related U.S. Application Data

[63] Continuation of Ser. No. 405,571, Oct. 11, 1973, abandoned, which is a continuation-in-part of Ser. No. 140,288, May 4, 1971, abandoned, which is a continuation-in-part of Ser. No. 796,298, Jan. 23, 1969, abandoned, which is a continuation of Ser. No. 631,685, April 18, 1967, abandoned.

[30] Foreign Application Priority Data

Apr. 22, 1966 Switzerland ..... 5877/66

[52] U.S. Cl. ..... 148/32.5; 75/152; 75/172 R; 75/174

[51] Int. Cl.$^2$ ..... C22C 19/00

[58] Field of Search ..... 148/31.55, 31.57, 32.5, 148/158, 11.5; 75/170, 172, 174, 152; 84/409, 452, 457

[56] References Cited

UNITED STATES PATENTS

| | | | |
|---|---|---|---|
| 2,303,404 | 1/1942 | Sivil | 75/172 |
| 3,117,862 | 1/1964 | Clark | 148/31.55 |
| 3,230,119 | 1/1966 | Gemmell et al. | 148/32.5 |
| 3,547,713 | 12/1970 | Steinemann et al. | 148/11.5 |
| 3,773,570 | 11/1973 | Steinemann et al. | 148/32.5 |

*Primary Examiner*—Walter R. Satterfield
*Attorney, Agent, or Firm*—Toren, McGeady and Stanger

[57] ABSTRACT

A vibratory or spring element. The element is formed from a paramagnetic alloy having a temperature coefficient of the moduli of elasticity between $-10^{-4}$ per centigrade and $+10^{-4}$ per centigrade and having the following further characteristics:

a. a magnetic atomic susceptibility $\chi$ of greater than $10^{-4}$ emu/g-atom at room temperature, corresponding to a specific heat (electron heat) of greater than $10^{-3}$ cal/g-atom(°K)$^2$ at low temperature;

b. a non-positive temperature coefficient $d\overline{N}(E_F)/dT$ of the effective density of states exhibited in a non-positive temperature coefficient $d\chi/dT$ of the magnetic susceptibility.

5 Claims, 6 Drawing Figures

INVENTOR
MARTIN PETER
SAMUEL STEINEMANN
BY McGlew and Toren
ATTORNEYS

INVENTOR
MARTIN PETER
SAMUEL STEINEMANN
BY: McGlevand Toren
ATTORNEYS

PARAMAGNETIC ALLOY

CROSS-REFERENCE TO PRIOR APPLICATIONS

This is a continuation of application Ser. No. 405,571 filed on Oct. 11, 1973, (now abandoned) which is a continuation-in-part application of Ser. No. 140,288 filed on May 4, 1971, (now abandoned) which in turn was a continuation-in-part application of Ser. No. 796,298 filed on Jan. 23, 1969 (now abandoned), which in turn was a continuation of application Ser. No. 631,685 filed Apr. 18, 1967 (now abandoned).

FIELD OF INVENTION

The invention relates to vibratory or spring elements made from alloys with a small temperature coefficient of elasticity.

SUMMARY OF THE INVENTION

For the production of vibratory or spring elements which have a temperature coefficient of the modulus of elasticity which is positive, zero or only slightly negative, that is to say between $-10^{-4}$ and $+10^{-4}$ per degree, it is the present practice to employ, among others, the so-called reversible Fe-Ni alloys, which, due to the temperature dependence of their magnetostriction, exhibit below the Curie point an anomalous temperature behavior of the elasticity and make it therefore possible to maintain the inherently negative thermoelastic coefficients very small over definite temperature intervals, and in fact positive or negative as desired. Vibratory elements of such materials are, however, sensitive to magnetic fields. It is furthermore already known that some nonferromagnetic materials also exhibit anomalous elasticity, whose origin lies, for example, in the formation of a superstructure or a reversible Martensite transformation. These anomalies extend, however, over only a relatively narrow temperature range and in fact cease at certain temperatures. A review of the phenomena is given in the paper by R. Straumann, F. Straumann and G. Krueger in "Scientia Electrica" Vol. 4 No. 2, 1958.

The known materials used in practice have certain disadvantages such as strong dependence upon processing (cold working, heat treatment) and upon magnetic fields and, moreover, they often have little resistance to corrosion, are difficultly workable and exhibit high mechanical losses.

It is the purpose of the present invention to avoid these disadvantages.

The present invention relates to vibratory or spring elements made from improved materials having a low temperature coefficient of elasticity.

The invention resides in a vibratory or spring element composed of a material which has a temperature coefficient of the elastic moduli in the range between $-10^{-4}$ and $+10^{-4}$ per degree, which is paramagnetic and has also a non-positive temperature coefficient of the magnetic susceptibility. The magnetic atomic susceptibility at room temperature is greater than $10^{-4}$ emu/g-atom. An electronic specific heat at low temperature of greater than $0.10^{-3}$ $$\frac{\text{cal}}{\text{g-atom } (°K)^2}$$

exhibits a condition corresponding to that of the high susceptibility; also high transition temperatures for supraconductivity can be a criterion. Under these conditions the effective density of states of the electrons at the Fermi-level $\bar{N}$ ($E_F$) is high; this density can be defined as the mean density of states of the itinerant electrons of highest kinetic energy over an energy range of the order kT ($k$ Boltzmann's constant, T temperature).

The elasticity behavior of a solid is determined by three contributions, namely a part of ion-ion interaction, a part of ion-electron interaction and a part of interaction between the itinerant electrons themselves. This latter contribution is ordinarily low or may have an influence only upon the absolute value of some elastic moduli of the single crystal. According to this invention however, the latter contribution of the itinerant electrons decides the elastic behavior in general, when under certain circumstances $\bar{N}$ ($E_F$) is high and $$\frac{d\bar{N}(E_F)}{dT}$$

is non-positive. This temperature derivative of the density of states is introduced in a formal manner; it stipulates a necessary variation of the effective density of states with temperature and correspondingly a necessary variation of the associated kinetic energy of the electrons in the solid.

The effective density of states N ($E_F$) is related to the magnetic susceptibility X through $$\chi = \mu^2 \bar{N} (E_F)$$

where $\mu$ is the Bohr Magneton. This relation states that the quantities and their temperature coefficients are proportional one to another and therefore corrlations between elastic behavior and density of states, susceptibility and its temperature coefficient are established.

The characteristics desirable for making vibratory or spring elements, or in general mechanical construction elements with sensibly constant elasticity, are obtained for values of $\chi$ larger than $10^{-4}$ emu/g-atom and with $d\chi/dT$ non positive. For metal alloys it is advantageous that the electron concentration $e/a$ for the overall composition or for main phase, falls inside the ranges $e/a =$ 2.7 – 3.3; 4.3 – 5.2; 6.4 – 7.3; 9.6 – 10.2. The dominant components of such alloys are transition elements of different groups or of group IIIB, VB, VIIB and the last column of group VIII of the periodic system of the elements; the other alloying elements are not necessarily transition elements. The particular elastic behavior of these solids is not directly dependent on crystal structure.

Such vibratory or spring elements may advantageously be used in time keeping mechanisms of watches and have for example the form of a spiral spring, a tuning fork, a torsion bar and the like. In electromechanical filters the element can have the shape of a bar which is excited for extensional vibrations or it may be a wire which transmits sound waves. Spring elements with small thermostatic coefficients are also employed for force measurements, for example in balances, electrical measuring instruments, leveling apparatus and similar devices.

In general it is to be noted that the mechanical stresses set up in the described vibratory or spring elements can be of various kinds. In this connection compensation relative to temperature variations is to be effected either for the modulus of elasticity, or Young's modulus, the shear modulus, or the compression modulus, individually or in combination. In vibratory elements, the elastic component is sometimes also adjusted to compensate for the different dilatation of an inertia component so as to retain temperature-independent frequency.

It should be noted that the two critical characteristics of the alloy from which the vibratory or spring element is made, to wit magnetic atomic susceptibility and specific heat are well known physical characteristics that are measurable quantities determinable by standard techniques.

The invention will now be explained more particularly with reference to the accompanyng diagrams wherein FIG. 1 shows the paramagnetic atomic susceptibility at room temperature, FIG. 2 shows the specific heats or electron heats (measured at the temperature of liquid helium), FIG. 3 shows the temperature coefficients of susceptibility (as a logarithmic derivative);

FIG. 4 diagrammatically illustrates the most favorable zones of the electron concentration *e/a;*

FIG. 5 is a curve of the paramagnetic susceptibility of the metals of group VB and the alloys thereof with respect to each other; and FIG. 6 is the curve of the temperature coefficients of the magnetic susceptibility.

The diagrams show these variables for the fourth, fifth and sixth periods, respectively, of the periodic system as a function of the electron concentration *e/a*, which is known as the ratio of the mean number of electrons outside closed shells, that is to say the number of electrons effective for bonding, to the number of atoms.

FIG. 4 shows the most favorable zones of the electron concentration *e/a*.

In the case of a binary alloy of elements 1 and 2, of which each can originate from any one group and any one period of the periodic system, with the weight percentages $g_1$ and $g_2$, the atomic weights $A_1$ and $A_2$ and the numbers $v_1$ and $v_2$ of the electrons outside closed shells (valencies), we may calculate the atom percentages $a_1$ and $a_2$.

$$a_1 = \frac{100 \cdot \frac{g_1}{A_1}}{\frac{g_1}{A_1} + \frac{g_2}{A_2}} \text{ and } a_2 = \frac{100 \cdot \frac{g_2}{A_2}}{\frac{g_1}{A_1} \cdot \frac{g_2}{A_2}}$$

and the electron concentrations $$e/a = (1/100)\,(v_1 \cdot a_1 + v_2 \cdot a_2.)$$

Thus with an alloy of 80% by weight of V and 20% by weight of Ti, the electron concentration $e/a = 4.79$; with an alloy of 80% by weight of Ti and 20% by weight of Cr $e/a = 4.37$; and with an alloy of 50% by weight of V and 50% by weight of Nb $e/a = 5.0$.

In particular, as may be seen from FIGS. 1 and 2 of the drawing, the susceptibilites $\chi$ and the specific electron heats $\delta$ of the alloys in the region where $e/a \approx 5$ are high. The density of states is therefore high. For these alloys the temperature coefficient of $\chi$ is negative so that all conditions are fulfilled for the existence of the required small temperature coefficient of the modulus of elasticity. Other cases showing similar behavior are for example palladium and platinum alloys, for which $e/a \approx 10$. The two examples show that there is independence of the crystal structure. The body-centered cubic Nb alloys as well as the face-centered cubic Pd alloys both have small temperature coefficients of the modulus of elasticity.

Figure 1:
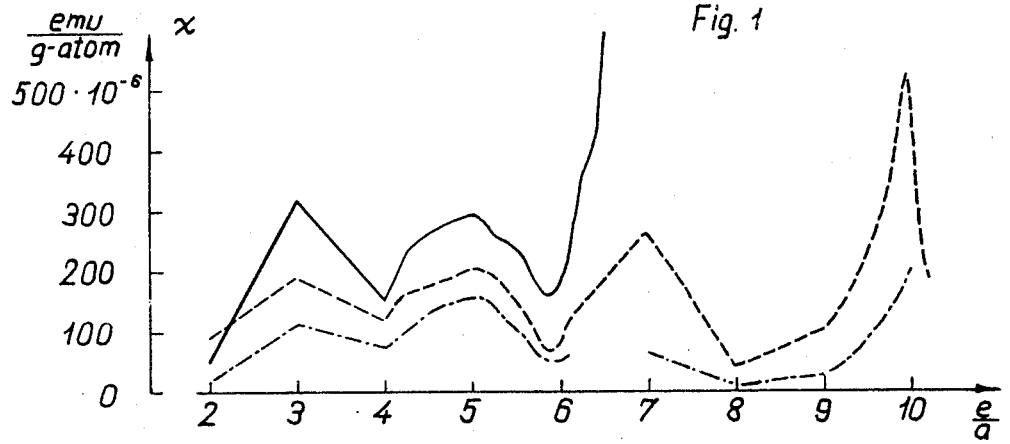
Figure 2:
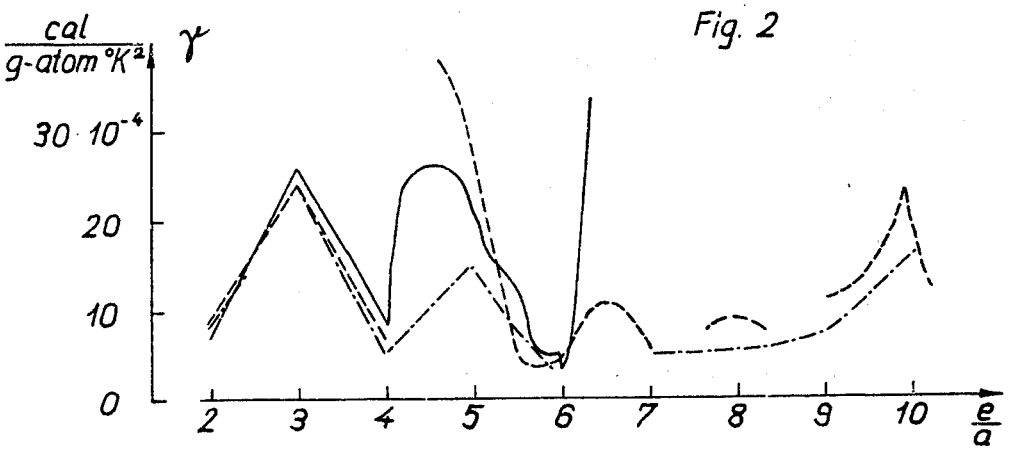
Figure 3:
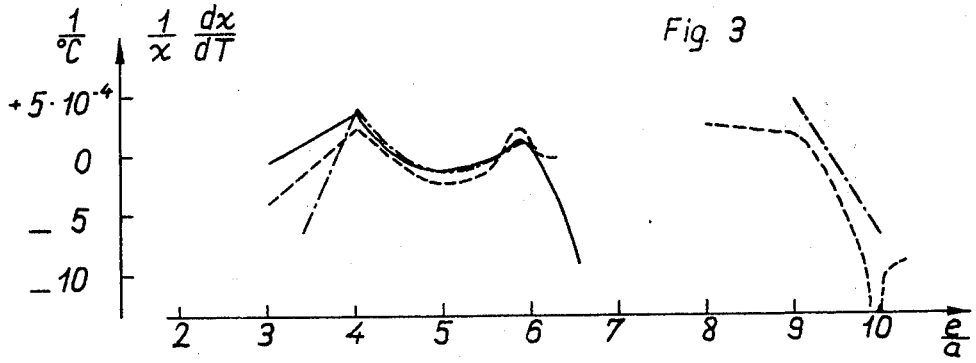
Figure 4:
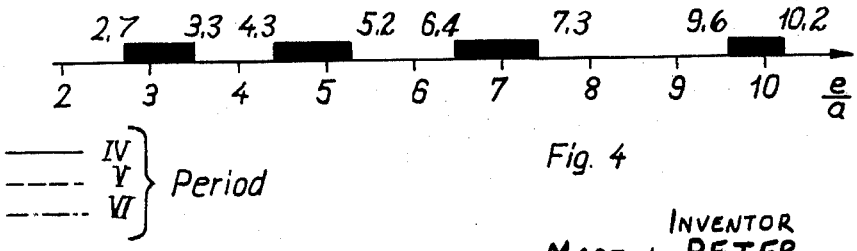
Figure 5:
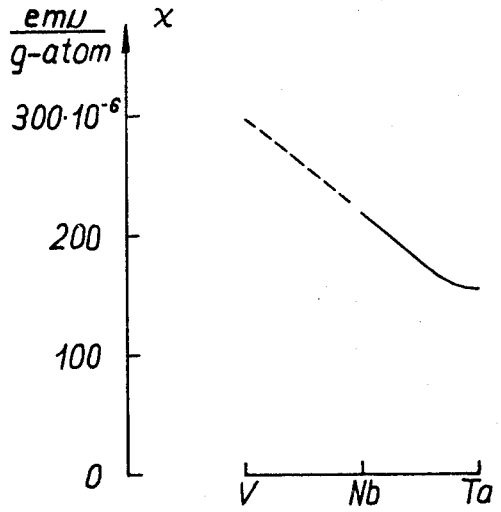
FIG. 5 shows the curve of the paramagnetic susceptibility of the metals of group VB and the alloys thereof with respect to each other, *e/a* is constant because the elements within a group of the periodic system have the same number of external electrons.
Figure 6:
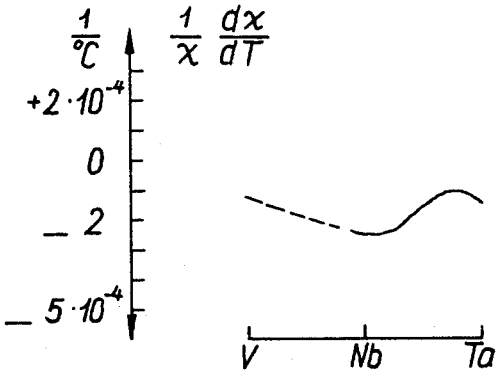
FIG. 6 shows the curve of the temperature coefficients of the magnetic susceptibility, that is to say $1/\chi \cdot d\chi/dT$, for the same alloy system. The desired elasticity characteristic therefore occurs also in such alloys which are formed from elements of different periods but the same group (in particular IIIB, VB or the last column of group VIII).

From FIGS. 1 to 4 it is evident that it is possible to determine by reference to the electron concentration *e/a* whether or not an alloy used for a vibratory or spring element can exhibit the desired property of temperature behavior of the modulus of elasticity. The alloy must have a global electron concentration *e/a*, or at least an electron concentration *e/a* of its predominating phase, in one of the following regions; 2.7 – 3.3; 4.3 – 5.2; 6.4 – 7.3; 9.6 – 10.2. In these various ranges of the alloy compositions the temperature coefficients of the elasticity are small, zero, or positive. For these ranges, however, the modulus of elasticity is different. For example in the following the rough order of magnitude of the modulus of elasticity E is given for these cases.

$$5000 \text{ kg/mm}^2 \text{ for } \frac{e}{a} = 2.7 - 3.3$$

$$10000 \text{ kg/mm}^2 \text{ for } \frac{e}{a} = 4.3 - 5.2$$

$$20000 - 30000 \text{ kg/mm}^2 \text{ for } \frac{e}{a} = 6.4 - 7.3$$

and $$15000 \text{ kg/mm}^2 \text{ for } \frac{e}{a} = 9.6 - 10.2$$

The alloys in accordance with the invention may be adapted to the particular purpose of use having regard to these different *e/a* values.

These required electron concentrations may result obviously also in alloys, wherein the individual elements or components of the alloy do not satisfy the required conditions as to electron concentration.

The following table shows examples of alloys with a value of *e/a* which lies within the prescribed limits and alloys with a value of *e/a* lying outside the prescribed limits. The first type is acceptable for vibratory elements and spring elements which must be to a large extent temperature independent, but the other alloys are not suitable for such purposes.

Table

| Weight % | | e/a | |
|---|---|---|---|
| 75 | Nb | 4.6 | acceptable |
| 25 | Ti | | |
| 80 | V | 4.79 | acceptable |
| 20 | Ti | | |
| 80 | Nb | 4.8 | acceptable |
| 20 | Zr | | |

Table -continued

| Weight % | | e/a | |
|---|---|---|---|
| 96 | Nb | 4.77 | acceptable |
| 4 | Al | | |
| 67 | Mo | 5.0 | acceptable |
| 33 | Ti | | |
| 50 | Nb | 5.0 | acceptable |
| 50 | V | | |
| 5.4 | Ti | 5.0 | acceptable |
| 10.8 | Mo | | |
| 83.8 | Nb | | |
| 80 | Mo | 5.8 | not acceptable |
| 20 | Nb | | |
| 90 | Sc | 3.05 | acceptable |
| 10 | Zr | | |
| 98 | Y | 3.0 | acceptable |
| 2 | Al | | |
| 45 | Co | 6.7 | acceptable |
| 14 | Fe | | |
| 41 | Ti | | |
| 60 | Ag | 10.6 | not acceptable |
| 40 | Pd | | |
| 95 | Pd | 9.95 | acceptable |
| 5 | Rh | | |
| 92 | Pd | 10 | acceptable |
| 8 | Pt | | |
| 98 | Pt | 9.98 | acceptable |
| 2 | Ir | | |
| 98 | Pt | 10.01 | acceptable |
| 2 | Cu | | |

EXAMPLE 1

This example deals with the manufacture of a spiral hair spring for a watch made from a Nb-Zr alloy with 80% Nb by weight. The alloy is prepared by melting together Nb and Zr either in an electron beam furnace or in a vacuum arc furnace. The ingot is then reduced by hot rolling at temperatures of 900° to 1300°C under an inert or reducing atmosphere to prevent oxidation. A sample cut from the bar has a magnetic susceptibility of $2.7 \cdot 10^{-4}$ emu/g-atom and a temperature coefficient of this susceptibility of minus $1.8 \cdot 10^{-4}$ per degree centigrade. At a diameter of about 5 mm the wire is ground to obtain a clean surface and then cold-drawn for further reduction to about 0.1 mm. Intermediate annealing in vacuum is required after reduction of 70–90% and this annealing is done under high vacuum at temperatures of 800° to 1100°C. The wire is then flattened in a rolling unit and coiled to the shape of the spiral hairspring and a final setting operation under high vacuum at 600° to 900°C is performed. The temperature coefficient of the elastic modulus is measured on a watch by looking at its rate at different temperatures and the result is then used to adjust the final setting heat treatment for optimum result. For the alloy under consideration, the setting operation inside the range of 600° to 900°C will always give temperature coefficients of between $-0.3 \cdot 10^{-4}$ and $+0.3 \cdot 10^{-4}$ per degree.

The same Nb-Zr alloy prepared by powder metallurgy did not give the desired result, the temperature coefficient of elasticity being strongly negative. It was found that the temperature behavior of susceptibility did not meet the required negative characteristic and by chemical analysis this could be attributed to a considerable proportion of interstitial impurities (oxygen and carbon) and other dissolved impurities (mainly Fe). The melted and wrought alloy as described above is the most convenient procedure for obtaining the desired results.

As a general proposition, melting and hot and cold working are the most advantageous if not the only practical procedures for obtaining the specified characteristics.

EXAMPLE 2

The Pd5 Rh alloy is a face-centered cubic metal of good ductility. The alloy is melted in a crucible under vacuum. A strip is obtained by hot rolling and cold rolling. From the strip a tuning fork is obtained by stamping. This vibrator also is subjected to a final heat treatment in the range of 400° to 700°C for stabilization purposes.

It should be reiterated that the density of states, a non-positive temperature coefficient of the density of states and the electron concentration are fully defined quantities in solid state physics, and the relations of these quantities to the atomic magnetic susceptibility and the specific heat are well known; (see for example C. Kittel "Solid State Physics", John Wiley & Sons Inc., New York 1966). Outstanding technological developments such as superconductive devices, semi-conductors, lasers and others, could not have reached their present level without acceptance of such quantities as practical parameters.

In order to examine the elasticity behavior of a material, it is necessary to examine the interrelationship between its physical properties. For ferromagnetic alloys where the interrelationship between magnetic properties and elastic properties, and between cold work and elasticity in magnetic fields are of major concern, the physical properties and their interaction have been studied (see, for example M. Bozarth "Ferromagnetism", Van Nostrand Publishing Company, for the $\Delta E$ effect). Disclosure of the chemical composition would not give the required information, since it would not reveal for example, the method of fabrication, heat treatment, phase structure, normal impurities and so on, all of which have a bearing on the physical properties of the material.

As contributory evidence for the unambiguity of a description by physical parameters, the following experimental example is given:

Alloy elements in the proportion 40% Nb to 60% Zr were melted in an electron beam furnace; the electron concentration was 4.4. The alloy was annealed at 1200°C under high vacuum, cold rolled and annealed again. One sample was permitted to cool in the furnace, and another sample was quenched. At room temperature, the sample which had been cooled in the furnace, had a temperature coefficient of elasticity of $-2.1 \cdot 10^{-4}$ per degree. Its susceptibility was $1.7 \cdot 10^{-4}$ emu/g-atom and the temperature variation of the susceptibility was slightly positive. At room temperature, the quenched sample showed nearly temperature-independent elasticity ($+0.2 \cdot 10^{-4}$ per degree), a susceptibility of $1.6 \cdot 10^{-4}$ emu/g-atom, and a negative temperature variation of the susceptibility. Metallurgical testing showed no difference in the hardness or in the microstructure of the two samples. X-ray diffraction showed only some blurring of the lines. The difference in the temperature variation of susceptibility in the two samples seemed to be a factor which determined the temperature coefficient of the elasticity, and a subsequent systematic search for suitable structural materials with temperature independent moduli of elasticity revealed different combinations of elements which were likewise distinguished by the non-positive temperature behavior of the susceptibility.

Theoretically, the relation between the temperature coefficient of elasticity and susceptibility is based on the contribution of the free electrons to the elasticity. Unlike corrosion-resistance or oxygen-resistance or other properties of a structural alloy, which are directly related to its chemical characteristics, the elastic behavior of an alloy is determined by the interaction of the free electrons under certain conditions which involve the density of states.

The figures in the drawing which bear upon the respective concentrations, do not represent a large number of alloy systems, since the figures include only binary alloys which differ from one another by one atomic number of the Periodic System. Alloys which differ by two or more atomic numbers must not meet the requirements, for example:

A 23% Zr 77% Nb alloy with *e/a* 4.77 has the required susceptibility and the required temperature behavior of elasticity, but a 61% Zr · 39% Mo alloy with the same value of *e/a* does not show the required temperature behavior of the susceptibility while the temperature coefficient of elasticity exceeds $-10^{-4}$ per degree.

The following further observations are made in respect of the preparation of the alloys:

A. The manufacturing methods for the working of paramagnetic alloys into vibratory or spring elements involves standard techniques well known to the skilled artisan.

B. It has been stated hereinabove that high transition temperatures for superconductivity is equivalent to a high density of states of electrons. The examples given in the specification in respect to Nb 25 Ti and Nb 20 Zr alloys represent superconducting materials which are widely used in the industry at the present time. The first high field superconductors which were used were Nb 25 Zr alloys which later were replaced by Nb 40 Ti alloys, because the latter can be fabricated in a simpler manner. These alloys were and are used in large quantities for the construction of magnetic coils and projects for magnetic levitation for trains. These alloy materials are used in the form of wires and strips of various sizes, usually embedded in copper. In multifilament wires the Nb Ti filaments may have diameters of a few $\mu$m only. The technology to produce such materials is well developed and applicable to the manufacture of the elements of the present invention. This technology involves standard procedures well known to the skilled art worker and explained in the present specification.

C. The Pd-base alloys, for example of the kind disclosed hereinabove are also manufactured by well developed procedures. Such materials are used typically for the production of jewelry, in dentistry, contact materials and the like.

Concerning alloy materials with electron concentrations of about 7, again the metallurgy involved is well known and developed.

As a general proposition, these materials are prepared by melting, either under vacuum conditions or under a protective non-oxidizing gas atmosphere. Nb-, V- and Ta-base alloys are relatively reactive as are metals having an electron concentration of 3, such as scandium, yttrium and lanthanum. Oxygen, as well as nitrogen, carbon and hydrogen, if introduced into such metals or alloys in quantities of the order of 1,000 ppm, embrittle the metals, thus rendering them more difficult to work.

The higher melting metals and alloys which are Group III and Group V based elements, can not normally be melted in crucibles, since the latter do not withstand the required high temperatures and the materials of the crucible walls have a tendency to react with the metals.

Dependent on the base material, the melting procedures customarily make use of the following techniques:

| Electron concentration range, base of alloy | | Technique |
|---|---|---|
| ~3 | Sc,Y,La | "cold crucible", vacuum |
| ~5 | V, Nb,Ta | "cold crucible", vacuum |
| ~7 | example CoFeTi | vacuum melting in crucible, or for purity "cold crucible" |
| ~10 | Pd, Pt | crucible, vacuum not necessarily required. |

The term "cold crucible" as used hereinabove, refers to a melting procedure which makes use of melting by electron beam, vacuum arc melting and the like. The molten metal is normally contained in water-cooled sheaths, which usually are made of copper.

D. The techniques referred to are well known in the art. Reference is thus had to "Zirconium" by Miller, Butterworths Scientific Publications, London, 1957, "Titanium" by McQuillan, Butterworths Scientific Publications, London, 1956, "The Science and Technology of Tungsten, Tantalum, Molybdenum, Niobium and Their Alloys", edited by N. E. Promisel, Pergamon Press, 1964, and "Vanadin, Niob, Tantal, Die Metallurgie der reinen Metalle und ihrer Legierungen", Kieffer and Braun, Springer Verlag, 1963. These publications make it clear that industrial processes for the production of high melting metals and alloys is standard technology.

The following comments are made in respect of the influence of the production procedure on the properties of the elements:

This specification includes examples for the preparation of alloy combinations and of their resulting properties (Nb, Zr, PdRh). After melting, the metals are customarily hot-rolled, annealed and cold-worked.

The preparation steps consisting of hot-rolling, annealing and cold-working, serve always a common aim in metallurgy, to wit, to produce a homogeneous metal or alloy of homogeneous chemical composition and to impart the metal or composition with a homogeneous grain structure. This is a well recognized concept which has been known for a long period of time. The steps of hot-rolling, annealing and cold-working are usually necessary for the indicated purpose, because cast metal or alloy exhibits segregation, to wit, a non-homogeneous composition which is the result of the solidification process per se (the difference of liquidus and solidus line in the phase diagram as explained and described in any textbook of elementary metallurgy). In addition, by casting, a coarse structure is obtained and the preparation steps referred to transform this coarse structure into a desired homogeneous grain structure. Therefore, in a pure metal the fabrication steps referred to exclusively serve the purpose to break down the cast structure.

From a practical point of view, it is certainly feasible, and in fact done for laboratory purposes, to obtain the desired homogeneous composition by merely subjecting the metal to annealing for an extended period of time near the melting temperature of the metal. It will be appreciated that this is impractical for industrial purposes and large casts. However, it will also be appreciated that the preparation steps referred to, at least from a theoretical point of view, are not necessary to obtain the claimed properties since, if sufficient annealing is effected, the desired properties will be obtained, at least in a portion of the metal or alloy, without hot-rolling and cold-working. For this reason, the preparation steps referred to in the application do not involve the crux of this invention, but merely are concerned with conventional process steps which are carried out for improving the result and for obtaining a higher yield of useful metal or alloy, these steps being well known to the skilled art worker.

Hot-working, annealing, and cold-working and annealing always serve the purpose in metallurgical procedures to homogenize the alloy with respect to chemical compositions and to obtain a regular grain structure. In metallurgical plants, e.g. for the production of steel, copper alloys and the like, these are essential production operations and require large machinery. These operations impart the metals with their ductility and strength and are generally referred to as "primary and secondary fabrication". The metallurgist knows that these operations influence the ductility and strength and in testing given metals he looks for the following:

1. The most advantageous temperature range for hot-working. As a general rule this range is in the region of 0.6 – 0.7 times the absolute melting temperature. This range is preferred because within this range diffusion is strong, diffusion facilitating the formation of a homogeneous composition.

2. A range for annealing temperatures. This range is usually chosen on the basis of two criteria, to wit, if only a softening of the metal is desired, after cold-working, or if also recrystallization should take place. For recrystallization purposes, the temperature should in practice be about 0.6 – 0.7 times the absolute temperature while for softening purposes the range is within 0.4 – 0.6 times the absolute temperature. This may be demonstrated by the following examples:

A Nb Zr alloy has a melting temperature of about 2,500°C; recrystallization is done at about 1,200°C, which is 0.65 $T_{melt,abs.}$ and softening of the metal, between cold-work, is done at 950°C which is 0.54 $T_{melt,abs.}$ Stainless steel, to obtain a fine grain, is annealed at 1,050°C; this is 0.62 $T_{melt,abs.}$ The metallurgical engineer knows how to find the "good" temperature range for hot-working and annealing processes and cold-work; all this is experience. The important and general proposition is merely that the processing is done to obtain chemical homogeneity and a favorable grain structure; thus, the purpose is to obtain good mechanical properties of strength and ductility.

If this homogenization, by hot-working, annealing, cold-work and annealing, is not effected, the elastic properties, in particular the small or zero temperature coefficient, still are the same. They show, however, some scatter in the absence of homogenization. The overall chemistry does not necessarily determine that behavior of a set composition which can be established in various samples cut from a larger cast block. To obtain very regular behavior requires working and annealing. This clearly is done in such a manner so as to obtain the desired shapes of the metal, thereby to form resonators, spiral hair springs, etc.

It follows that the properties with which this application is concerned are not substantially affected by the working procedure.

What is claimed is:

1. A vibratory or spring component formed from a worked and heat treated alloy wherein the alloy constituents consist essentially of an element selected from the group consisting of scandium, yttrium, lanthanum, niobium, tantalum, vanadium, palladium and platinum alloyed with a minor constituent selected from the group consisting of titanium, zirconium, aluminum, molybdenum, cobalt, iron, rhodium, iridium, silver and copper and wherein at least one of the elements of said alloy has an electron concentration lying outside of the following ranges:

2.7 – 3.3

4.3 – 5.2

6.4 – 7.3

9.6 – 10.2 said alloy being paramagnetic, and possessing:

a temperature coefficient of the moduli of elasticity between $-10^{-4}$ per °C and $+10^{-4}$ per °C;

a magnetic atomic susceptibility $\chi$ of greater than $10^{-4}$ emu/g-atom at room temperature, corresponding to a specific heat of greater than $10^{-3}$ $$\frac{\text{cal}}{g\text{-atom } (°K)^2}$$

at low temperature and;

a non-positive temperature coefficient $(dN/dT)(E_F)$ of the effective density of states exhibited in a non-positive temperature coefficient $d\chi/dT$ of the magnetic susceptibility.

2. A vibratory or spring element as claimed in claim 1, wherein the electron concentration $e/a$ lies within the range 2.7 – 3.3.

3. A vibratory or spring element as claimed in claim 1, wherein the electron concentration $e/a$ lies within the range 4.3 – 5.2.

4. A vibratory or spring element as claimed in claim 1, wherein the electron concentration $e/a$ lies within the range 6.4 – 7.3.

5. A vibratory or spring element as claimed in claim 1, wherein the electron concentration $e/a$ lies within the range 9.6 – 10.2.

* * * * *